US009221640B2

(12) United States Patent
Middleberg et al.

(10) Patent No.: US 9,221,640 B2
(45) Date of Patent: Dec. 29, 2015

(54) METHOD AND SYSTEM FOR SEMI-AUTOMATED TRAY LOADING DEVICE

(71) Applicant: BELL AND HOWELL, LLC., Durham, NC (US)

(72) Inventors: Neal Middleberg, Apex, NC (US); Gerard A. Derome, Cary, NC (US); Richard D. Johnson, Fuquay-Varina, NC (US); Lenny Neifert, Apex, NC (US); Mark Gerard Paul, Raleigh, NC (US)

(73) Assignee: Bell and Howell, LLC, Durham, NC (US)

( * ) Notice: Subject to any disclaimer, the term of this patent is extended or adjusted under 35 U.S.C. 154(b) by 306 days.

(21) Appl. No.: 13/844,290

(22) Filed: Mar. 15, 2013

(65) Prior Publication Data

US 2013/0294879 A1 Nov. 7, 2013

Related U.S. Application Data

(60) Provisional application No. 61/641,716, filed on May 2, 2012.

(51) Int. Cl.
*B65H 31/06* (2006.01)
*B65H 29/00* (2006.01)
(Continued)

(52) U.S. Cl.
CPC ..... *B65H 29/00* (2013.01); *B65H 31/06* (2013.01); *B65H 31/3072* (2013.01); *B65H 31/3081* (2013.01); *B65H 33/06* (2013.01);
(Continued)

(58) Field of Classification Search
CPC ..... B65H 39/00; B65H 33/08; B65H 31/06; B65H 29/64; B65H 2801/78; B65H 2801/66; B65H 2701/1313; B65H 31/36; B65H 31/3072; B07C 1/025; B07C 1/04; B07C 1/06
USPC ..... 414/789; 271/285, 286; 53/542, 247, 53/260
See application file for complete search history.

(56) References Cited

U.S. PATENT DOCUMENTS 4,518,160 A * 5/1985 Lambrechts et al. ..... 271/214
4,643,626 A * 2/1987 Noguchi et al. ..... 414/798.2
(Continued)

FOREIGN PATENT DOCUMENTS

EP 1790591 A1 5/2007

OTHER PUBLICATIONS

European Search Report issued in European Application No. 13166231.4-1705 dated Apr. 17, 2014.

*Primary Examiner* — Saul Rodriguez
*Assistant Examiner* — Lynn Schwenning
(74) *Attorney, Agent, or Firm* — Jenkins Wilson Taylor & Hunt P.A.

(57) ABSTRACT

The present application relates to techniques and equipment to stack mailpieces for sweeping. The mailpieces are manufactured on a mail processing machine such as, but not limited to an inserter or wrapper. More particularly, there is provided an on-edge conveyor where components have been ergonomically positioned to permit the filling of a mail tray in an efficient manner with minimal lifting of weight. A quantity of mailpieces that have already been offset can be pulled over the rolled/rounded edge of the conveyor into an awaiting mail tray supported on a roller conveyor. The operator is then able push the full tray to the side, load another empty tray, and repeat the process.

20 Claims, 9 Drawing Sheets

(51) Int. Cl.
*B65H 31/30* (2006.01)
*B65H 33/06* (2006.01)

(52) U.S. Cl.
CPC ..... *B65H2301/4214* (2013.01); *B65H 2301/422548* (2013.01); *B65H 2404/154* (2013.01); *B65H 2601/325* (2013.01); *B65H 2701/1916* (2013.01)

(56) References Cited

U.S. PATENT DOCUMENTS

| | | | | |
|---|---|---|---|---|
| 4,903,955 | A | 2/1990 | Manzke | |
| 5,125,214 | A * | 6/1992 | Orsinger et al. | 53/460 |
| 5,253,859 | A | 10/1993 | Ricciardi | |
| 5,271,710 | A * | 12/1993 | Decharran et al. | 414/798.9 |
| 5,485,989 | A * | 1/1996 | McCay et al. | 271/2 |
| 5,503,388 | A * | 4/1996 | Guenther et al. | 271/300 |
| 6,398,204 | B1 | 6/2002 | Keane et al. | |
| 7,089,717 | B2 * | 8/2006 | Guttinger et al. | 53/475 |
| 2002/0017447 | A1 | 2/2002 | Emigh et al. | |
| 2004/0080096 | A1 * | 4/2004 | Holbrook | 271/185 |
| 2004/0113355 | A1 | 6/2004 | Antonelli et al. | |
| 2010/0106290 | A1 * | 4/2010 | Isles et al. | 700/227 |
| 2010/0198391 | A1 | 8/2010 | Schafer | |
| 2011/0192892 | A1 * | 8/2011 | Van Gorp et al. | 229/301 |

* cited by examiner

METHOD AND SYSTEM FOR SEMI-AUTOMATED TRAY LOADING DEVICE

CROSS-REFERENCE TO RELATED APPLICATIONS

This application claims the benefit of U.S. Provisional Application No. 61/641,716 entitled "METHOD AND SYSTEM FOR SEMI-AUTOMATED TRAY LOADING DEVICE" filed on May 2, 2012, the disclosure of which is entirely incorporated herein by reference.

TECHNICAL FIELD

The present subject matter relates to techniques and equipment to stack mailpieces for sweeping. The mailpieces are manufactured on a mail processing machine such as, but not limited to an inserter or wrapper.

BACKGROUND

Shingling conveyors are used to stack finished envelopes from an inserter or wrapper. They are the most common mechanism to collect finished envelopes produced by an inserter in today's mailing environment. With this type of conveyor, an operator will "sweep the belt", which essentially amounts to an operator using both his/her hands to pull as many envelopes/mailpieces together as possible, and still be able to lift them into an awaiting mail tray which is typically on a table or cart near the end of the conveyor. Because the mailpieces are manually lifted off the conveyor and carried to the tray, the size of the bundle of mailpieces is limited by the strength and dexterity of the operator. Failure of the operator to grip the selected bundle of mailpieces firmly enough can easily result in loosing control of the center of the bundle when lifting and moving the bundle to a mail tray which is positioned to the side or behind the operator. It should be readily apparent that tumbling a bundle of mailpieces to the floor during the sweeping operation causes a significant delay in operations due to clean up.

The sweeping process is repeated until the tray is full. Tray break marks or an offset of a single mailpiece alerts the operator where the end of the bundle of mailpieces occurs and a new tray must be started. This process is time consuming, risks missing a tray break and requires a significant amount of lifting. In addition, significant time can be saved by eliminating the step where an operator has to search for the tray break mark. If the operator fails to sweep the stacker conveyor at the speed at which the inserter produces mailpieces, the inserter must be stopped until there is free space on the stacker conveyor. Stoppage effects production throughput. Operator fatigue from lifting, turning and placing a mail bundle in the correct mail tray increases the probability of tray sweeping errors, of stoppage for operator rest or additional staff to allow for rest without inserter stoppage.

Hence a need exists for an on-edge conveyor where common components have been ergonomically positioned to permit the filling of a mail tray in a matter of seconds (e.g. less than 5 seconds) with minimal lifting of weight, i.e. a quantity of envelopes that has already been offset can be pulled over the rolled/rounded edge of the conveyor into an awaiting mail tray supported on a roller conveyor. The operator would then push the full tray to the side, load another empty tray, and repeat the process.

SUMMARY

In one aspect of the present application, a stacker system for stacking mailpieces received from an output section of mail processing equipment is provided. The stacker system comprises an in-feed transport section for receiving the mailpieces from the output section of the mail processing equipment. A stacker module is configured to receive the plurality of mailpieces, by their leading edges, in an on-edge orientation and stack the mailpieces to form a mailpiece tray bundle. A conveyor module includes at least one conveyor drive belt and a wear plate having a rounded edge. The wear plate is configured to receive the mailpiece tray bundle driven by the conveyor drive belt. The trailing edges of the mailpieces of the mailpiece tray bundle are justified at the rounded edge of the wear plate. A roller conveyor is positioned below the edge of wear plate and parallel with the conveyor module. The roller conveyor is configured to receive the mailpiece tray bundle over the rounded edge of the wear plate and into a mail tray positioned on the roller conveyor. The rounded edge of the wear plate overhangs the roller conveyor such that the mail tray bundle can be slidably moved across an upper surface of the rounded edge without damaging the mailpieces.

In another aspect, a method for stacking mailpieces is provided. The method comprises the steps inputting, at an in-feed transport section of a stacker system, the mailpieces from an output section of mail processing equipment. The plurality of mailpieces are received in an on-edge orientation in a stacker module. The mailpieces are stacked in the stacker module to form a mailpiece tray bundle. The trailing edges of the mailpieces of the mailpiece tray bundle are justified at a rounded edge of a wear plate of a conveyor module. The mailpiece tray bundle is conveyed along conveyor belts of the conveyor module. The mailpiece tray bundle is swept over an upper surface of the rounded edge of the conveyor module and into a mail tray positioned on a roller conveyor below the rounded edge of the wear plate. The rounded edge of the wear plate overhangs the roller conveyor and the mailpiece tray bundle is slidably moved across the upper surface of the rounded edge without damaging the mailpiece tray bundle and without having to lift up the mailpiece tray bundle.

The advantages and novel features are set forth in part in the description which follows, and in part will become apparent to those skilled in the art upon examination of the following and the accompanying drawings or may be learned by production or operation of the examples. The advantages of the present teachings may be realized and attained by practice or use of the methodologies, instrumentalities and combinations described herein.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
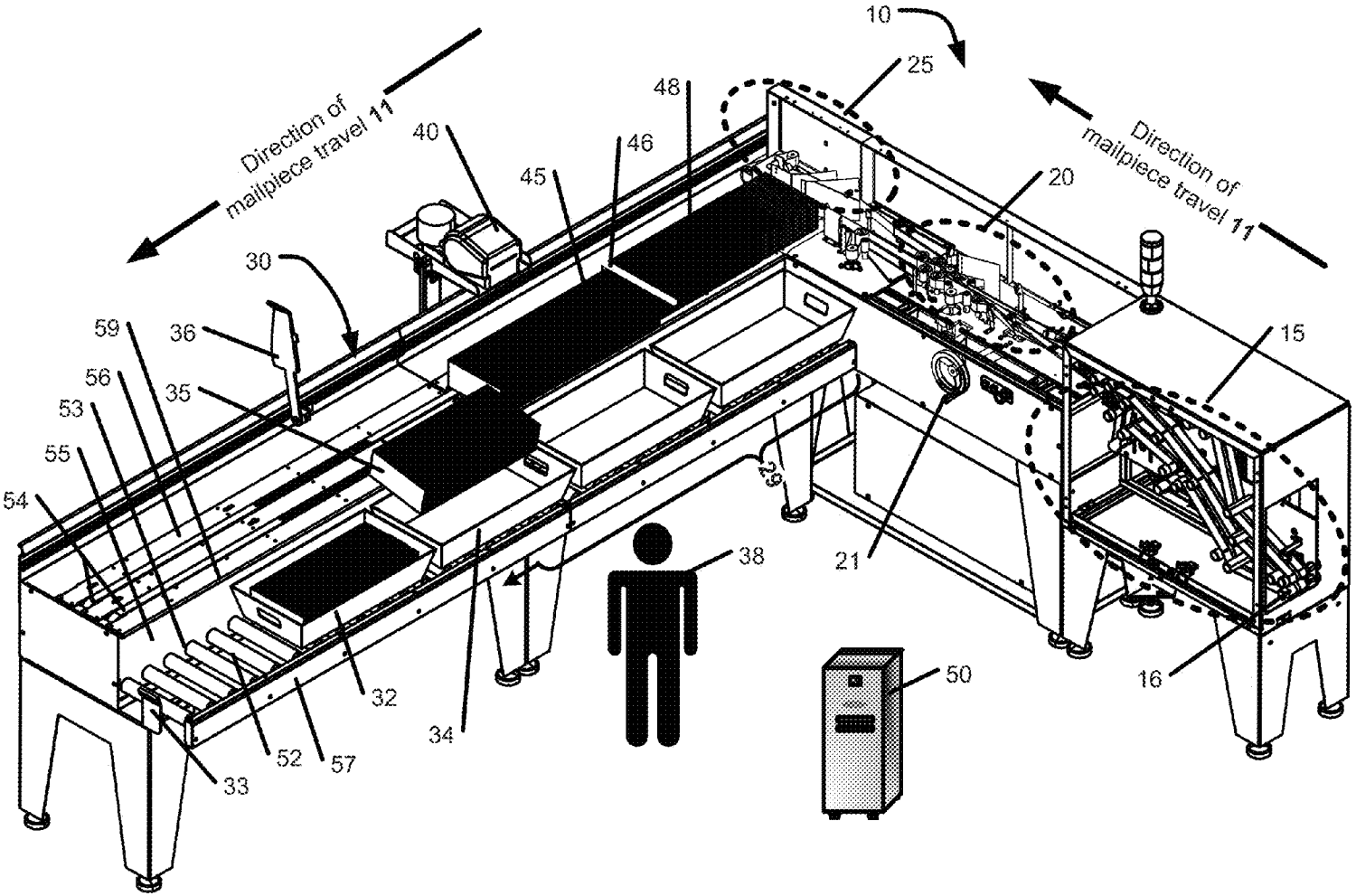
FIG. 1 is an exemplary illustration of the on-edge stacker/conveyor system components.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

The teachings herein alleviate one or more of the above noted problems by the unique positioning of key common conveyor components in such a way to maximize the potential throughput of the machine by greatly reducing a common bottle neck—the time it takes to offload "sweep" the conveyor stacker, while at the same time maximizing the ergonomic benefit to the operator by eliminating the need to lift mail. Some important features include: 1) a method for adapting to various upstream devices, e.g. inserter, with different output heights and either standing up or laying flat, 2) a method for standing mail on-edge, with either clockwise (CW) or counter clockwise (CCW) rotation from a flat position depending on the orientation of the envelope and the orientation of the stacker conveyor—attached on the right or left side of the on edge stacker system, 3) a method for offsetting the on-edge material 90° onto a conveyor, 4) a conveyor that is sufficiently long so as to not adversely affect throughput, 5) an attached roller transport to support mail trays between the operator and the conveyor, 6) a smooth rounded edge on the stacker conveyor on which mailpieces can rest while being transitioned to the mail tray and 7) clearly defined tray breaks where the entire bundle of mailpieces to be swept into a tray are offset on the stacker conveyor for easy identification and gripping.

In one example, the features that enable an operator to fill 5 mail trays, each containing approximately 400 mailpieces and weighing 15 lbs each in 13 seconds, thus keeping up with inserters that can process 10,000 to 30,000 mailpieces per hour all without having to "lift" the mail off the conveyor—are listed below and illustrated in detail in the figures.

The mail on the conveyor is biased to the trailing edge, i.e. the edge of the conveyor closest to the operator. This is the case regardless of the size of the envelope. A backstop that adjusts for different envelope lengths is used to maintain consistent edge registration. When the mail is offset for tray breaks, it will be approximately one inch back from that trailing edge.

The geometry of the conveyor edge closest to the operator will be smooth and rounded, either fixed or rotating, and will have minimal drag or friction on the envelopes as they are pulled over the edge into the mail tray.

All of the mail destined for a mail tray is standing upright in an offset block. This orientation prevents the operator from having to sweep shingled mailpieces into a vertical position before practically loading a mail tray.

The mail tray will be positioned slightly under this conveyor edge to minimize the risk of the mail catching on the side of the tray as it is pulled over the edge. Since typically mail trays are bowed out in the middle, this added feature should minimize the risk of tumbling the mail during the loading process.

Lifting the mail bundle is eliminated since the mail is being pulled over the conveyor edge down into the tray.

As a result of these features, the operator is not lifting the typical 15 lbs per mail tray, but rather, sliding the mailpiece bundle into the tray. For an inserter running 30,000 mailpieces per hour, this is equivalent to eliminating the lifting of 1125 lb/hr.

Reference now is made in detail to the examples illustrated in the accompanying drawings and discussed below. FIG. 1 illustrates the component parts of the on-edge stacker system 10 which is attached to an inserter or wrapper. The inserter consists of an input channel for documents to be inserted, insert feeders, envelope inserter and an on edge stacker system 10. A wrapper system includes an input channel for documents to be inserted, insert feeders, a wrapping system to wrap the document and inserts with paper that is fed from a continuous roll of paper and an on edge stacker system 10. The on edge stacker system 10 is made up of four major subassemblies: the in-feed transport module 15; the twist module 20; the stacker module 25; and the stacker conveyor module 30. These modules form the output system for an inserter or wrapper mail processing system. The finished mailpieces are input to the in-feed transport module at the roller nip 16 and proceed along the indicated directional arrows 11. The input roller nip 16 is adjustable in height to accommodate various inserters or wrappers without having to replace belts in the in-feed transport module 16. The in-feed transport module 15 elevates the mailpieces from the input roller nip 16 to the twist module 20 to accommodate various exit heights from inserters and wrappers. The twist module 20 is at a set height defined by the most beneficial ergonomic configuration needed to create minimum fatigue for the operator 38 sweeping mailpieces from the stacker conveyor 30 into empty trays 34.

Figure 1A:
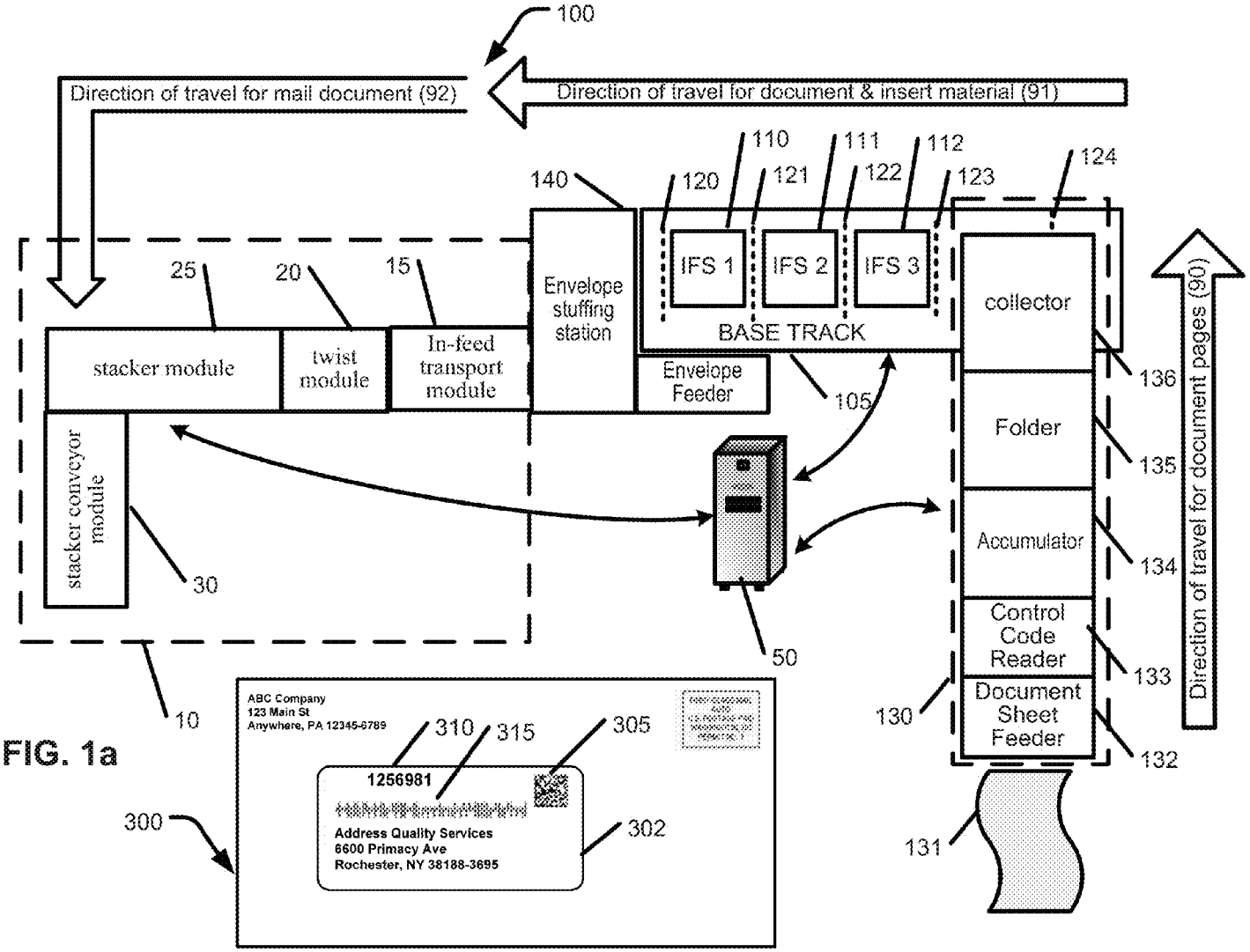
FIG. 1*a* is an exemplary diagram of an inserter system on which the on-edge stacker/conveyor system is attached.

FIG. 1*a* illustrates the component parts of an exemplary inserter system 100 to which the on-edge conveyor system 10 is attached and through which documents are tracked in order for the control computer 50 to control the tray group offset subassembly (FIG. 3*b*, components 70, 72 and 73) to operate when a tray group ends and a new tray group begins. The backbone of an inserting system is the base track 105 which transports the partially assembled document material to be stuffed in an envelope. The partially assembled document material may consist of a document plus inserts. The base track 105 generally has one or more insert feeder stations (IFS) 110 through 112 to add insert material to the base track 105. The material is moved down the base track 105 in direction 91 by fingers 120 through 124 which are attached to a continuous chain or belt to form track sections between each of the finger pairs. Attached to the base track 105 is the input channel 130 that provides documents consisting of one or more pages to the base track 105. The input channel 130 processes and transports the document pages from the document sheet feeder 132 to the collector 136 in the direction 90. Multiple input channels may be attached to the base track 105. The input channel 130 processes cut sheet or fan folded document pages 131 with a document feeder 132. Alternately the document pages may be printed on a paper roll and fed into a cutter assembly that will separate the document into individual pages. The inserting system 100 operation may be controlled by reading a control code 305 on the letter 300 which is read with a control code reader 133. The control code 305 may contain the inserting instructions or a reference to a data file maintained in the control computer 50. Those skilled in that art may use other formats for the control code other than the 2-D barcode 305 shown on letter 300. Other barcodes may include the USPS Intelligent Mail® barcode 315 (IMb) and Optical Mark Recognition (OMR) codes. When the IMb includes a unique number encoded in the barcode, this unique number can be used as a reference code to reference a control data file in the control computer 50. Similarly, unique alphanumeric data such as a sequence number 310 can be used as a reference code to reference a control data file in the control computer 50. The use of a control code to define the characteristics of the mail document contents is referred to as database driven insertion. Envelope 300 illustrates an example where the control code 305 is visible through the address block window 302. Visibility through the window 302 is not a requirement since control codes located in other positions on the document page can be read by the control code reader 133. The contents of the envelope may contain a document of one or more pages and inserts such as but not limited to coupons, advertisements and return envelops.

The data associated with the control code may specify parameters that affect the performance of the input channel 130. These parameters include, but are not limited to, document page count, paper thickness, fold type, inserts required and delivery point ZIP code. Once the control code reader 133 has read the delivery point or obtained the delivery point from a file referenced using a read unique reference and passed the delivery point data to the control computer 50, the document may be tracked through the accumulator 134, folder 135, collator 136, base track 105 and the envelope stuffing engine 140 where the finished envelope is handed off to the on-edge conveyor 10. Tracking of the finished mailpiece continues in the on-edge conveyor 10 as the mailpiece is transported 92 through the in-feed transport module 13, the twist module 20 and arrives at the stacker module 25 where the off-set assemble controls whether the mailpiece is added to the tray bundle current tray bundle or a new tray bundle is started by actuating or releasing the movable stop 72. Those skilled in the art of tracking a document or envelope through an inserter or wrapper will employ a variety of photocells and encoders to measure speed. In addition, computer algorithms in the control processor 50 will utilize the photocell data and encoder data to perform the required tracking.

Figure 1B:
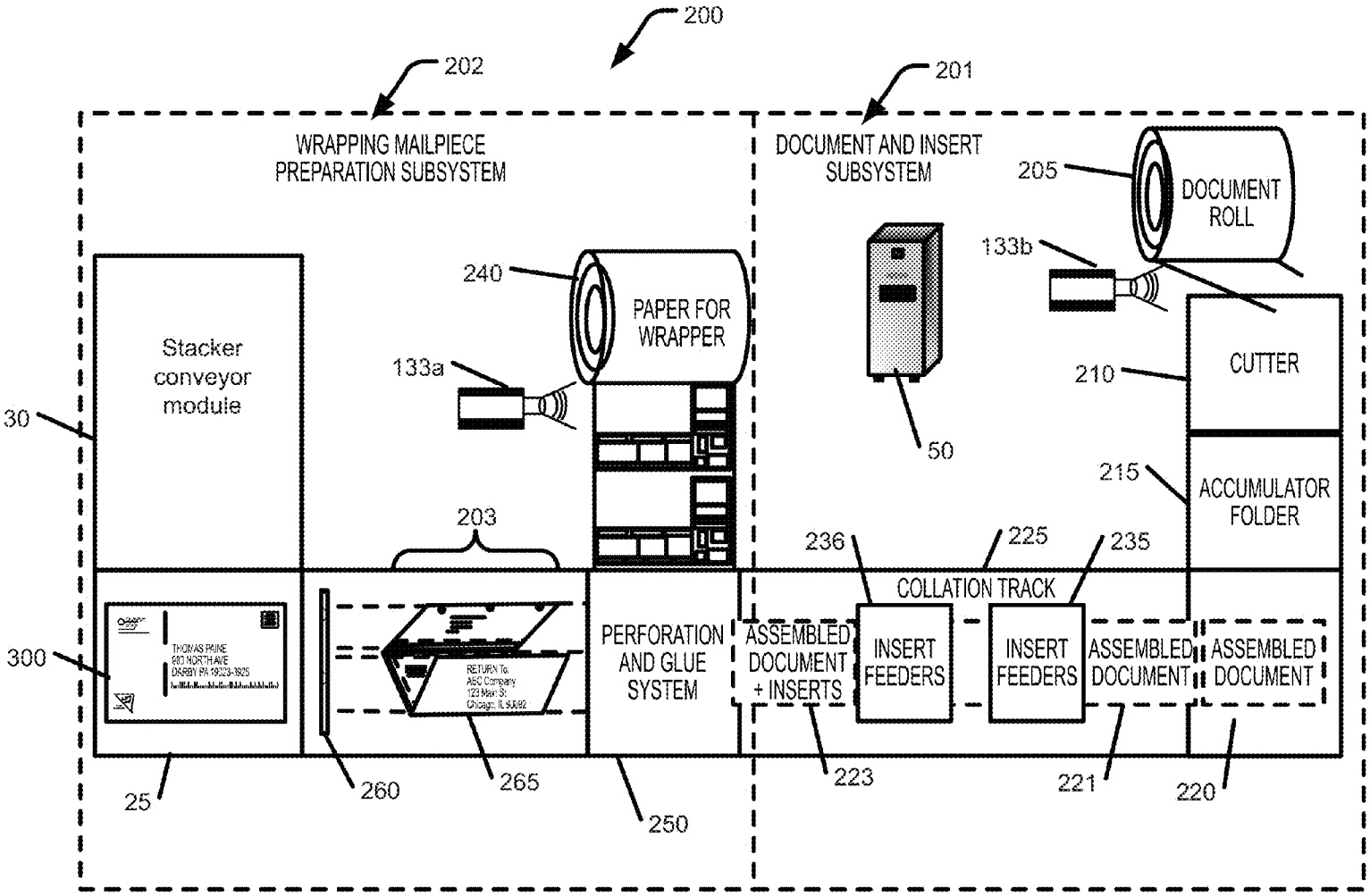
FIG. 1*b* is an exemplary diagram of a wrapper system on which the on-edge conveyor system is attached.

FIG. 1*b* illustrates the component parts of an exemplary wrapper system 200 to which the on-edge conveyor system 10 is attached and through which documents are tracked in order for the control computer 50 to control the tray group offset subassembly (FIG. 3*b*, components 70, 72 and 73) to operate when a tray group ends and a new tray group begins. The wrapper 200 has two locations where the control code may be read. First is control code reader 133*b* which reads the control code data or database reference data to determine the delivery point for the document contained in the paper roll 205. This is the same process as described above for the inserter. The second code reader 133*a* is on the output of the paper for wrapper roll 240. This is required because the documents on roll 240 may be a complete mailpiece and contain no documents or inserts, hence on control codes. The document and insert subsystem 201 is similar to an inserter. The exemplary illustration of subsystem 201 contains a cutter 210, an accumulator folder 215 to assemble the document 220. The assembled document 221 is placed on the collation track 225 and passes under insert feeders 235 and 236 where inserts are added. The assembled document+inserts 223 bypasses the perforation and glue system 250 and enters the wrapper 203 where it is enclosed it the wrapper paper 265. The wrapper material is cut 260 from the continuous roll to form the finished mailpiece 300. Different configurations of the in-feed transport module 15 and twister 20 and are emitted from FIG. 1*b*. Document and mailpiece tracking are performed with similar technology as the inserter described above. Therefore, when the mailpiece reaches the stacker module 25 the delivery point is known and the control processor 50 can actual or retract the movable stop 72 depending on whether the mailpiece is for the current tray bundle or a new tray bundle. The wrapping mailpiece preparation subsystem 202 is unique from an inserter except for the tracking process. Each section of the paper for wrapper 240 roll can become a mailpiece depending on the configuration being run. If the control code is on the wrapper, the control reader 133*a* will read it and then the control processor 50 will track the document to the stacker module 25. Glue and perforations are added to the wrapper paper as required by subsystem 250 before the paper 265 is wrapped 203 to form a mailpiece.

Returning attention to FIG. 1, at the start of operation, the operator 38 positions empty mail trays 34 on the roller conveyor 29. The operator 38 will add additional trays 34 as full trays 32 are removed. FIG. 1 illustrates a mailpiece tray group 48 of mailpieces in the off-set position being accumulated on the stacker conveyor 30. A completed mail tray group 45 in the normal position (no offset and justified close to the operator) is illustrated next on the stacker conveyor 30. The mailpiece tray group offset subassembly is explained as part of FIGS. 3*b*, 4 and 5 and is controlled by the inserter or wrapper control computer 50. For purposes of illustration, the boundary between mailpiece tray groups is marked with a white line 46. The white line 46 does not imply that mailpieces are missing or that a gap is created. The mailpiece tray group 45 is shown as larger than a mail tray 34 since it has not yet been compressed by the operator 38 as part of the sweeping process. Newly manufactured mailpieces contain air between the folded contents which makes the mailpiece tray groups highly compressible. Without compressing the mailpiece tray group 45, the mail tray 34 would not be filled to capacity, plus the risk of tumbling the tray group 45 on the floor would be higher even though the operator 38 does not lift the tray group 45. Mailpiece tray groups often represent delivery point groupings defined by the postal authority for which the postal authority will offer pre-sort postage discounts. Other groupings may be defined by those skilled in the art depending on operational considerations. These alternate groups may be dictated by, but are not limited to, the next operation such as sorting or distribution to another location to be merged with other mail for higher postage discounts.

Figures 3, 3A, 3B, 3C:
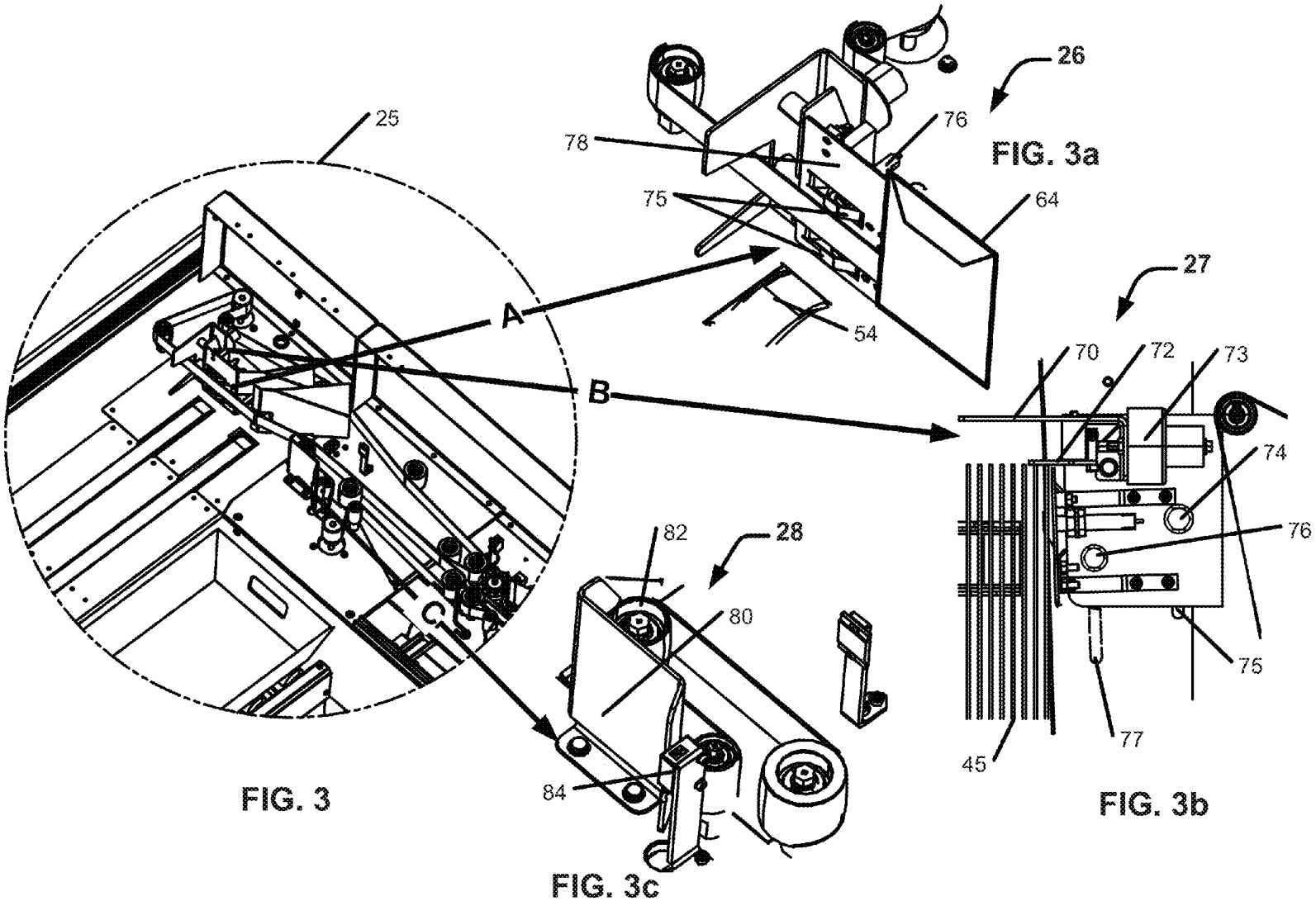
FIG. 3 is an exemplary illustration of the stacker module.
FIGS. 3*a*, 3*b* and 3*c* are expanded view illustrations of the on-edge stacker conveyor control assembly; the tray break offset assembly and the tail roller assembly respectively.
Figure 8:
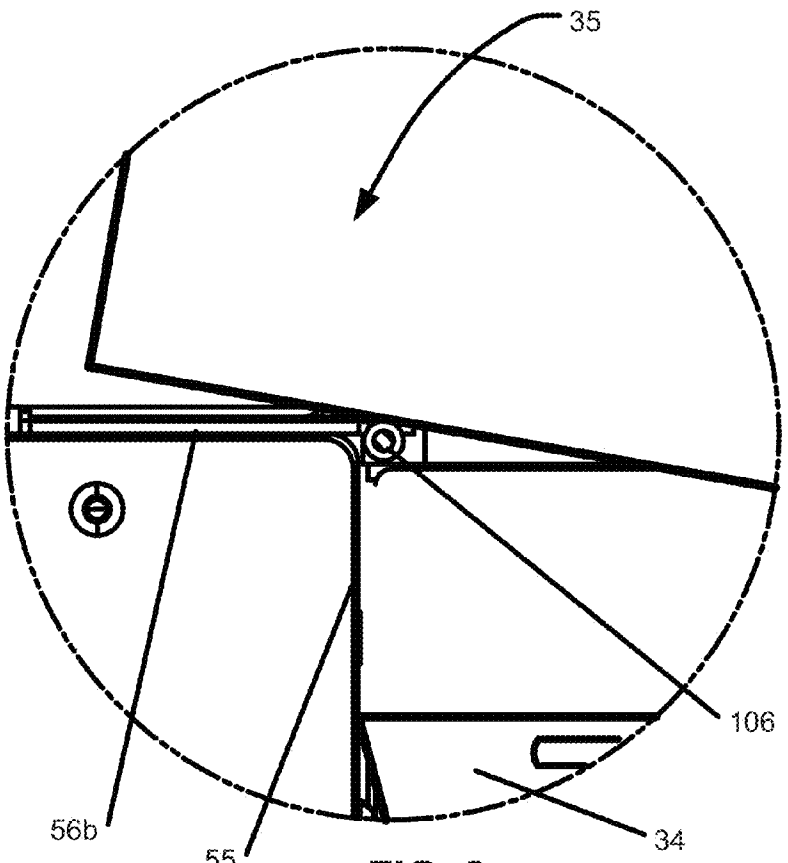
FIG. 8 is an exemplary illustration of a mail bundle being slid over the edge of the stacker conveyor where the edge has a roller assembly.
Figure 7:
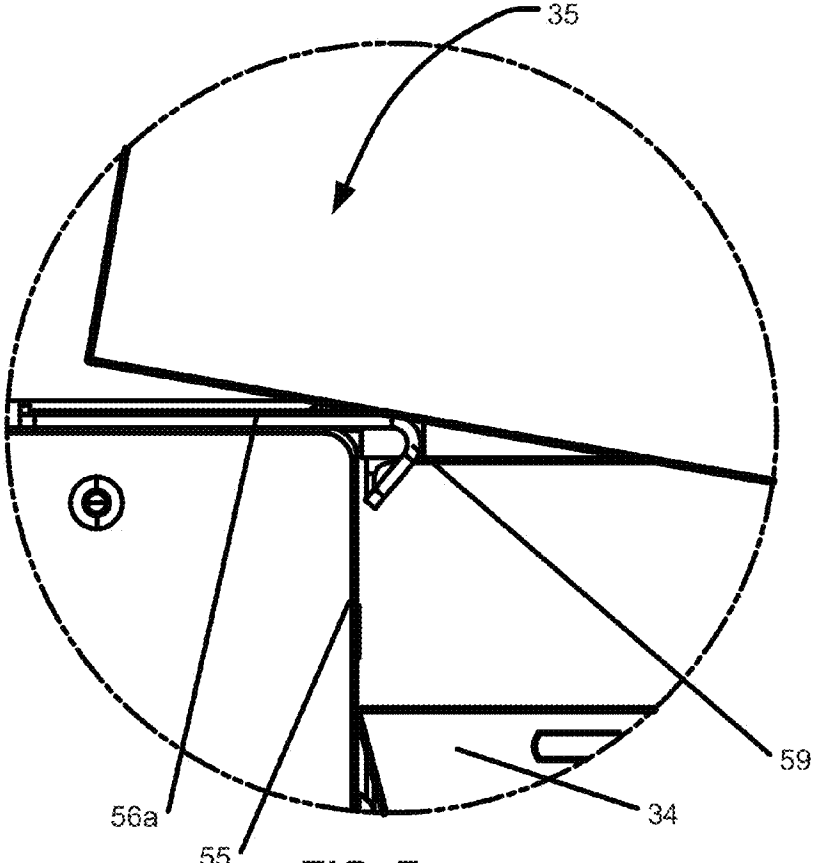
FIG. 7 is an exemplary expanded view illustration of a mail bundle being slid over the rounded edge of the stacker conveyor.

Mailpiece tray group 35 is compressed and ready to load into an empty mail tray 32. The stacker paddle 36 is rotated to the up position so that it does not interfere with the sweeping operation. The stacker paddle 36 is in the down position between sweeping operations, to prevent the last mailpieces in the adjacent mailpiece tray group 45, from falling over on the stacker conveyor 30. The stacker paddle 36 has a tab on the bottom that rests in the grove of the toothed conveyor drive belts 54. This configuration ensures that the stacker paddle 36 is tight against the mailpiece tray bundle 45 but is able to move as the drive belts 54 move the mailpiece tray bundles 48 and 45 down the stacker conveyor. The control of the conveyor drive belts is illustrated in FIG. 3*a*. The stacker conveyor 30 is configured, for example, with a stainless steel wear plate 56 that reduces friction on the drive belts 54 and the sliding mailpiece tray groups 48 and 45. The mailpiece tray group 35 rests on the edge 59 of the wear plate during the sweeping operation. Attention is directed to FIGS. 7 and 8 for a detailed illustration of the unique features of this edge which facilitates the smooth sliding of mailpiece tray group 35 from the stacker conveyor 30 into the empty tray 34. When a mail tray is completed 32, the operator will obtain a tray tag to affix to the tray from the tray tag printer 40. The control computer 50 establishes the tray group characteristics based on the mailpiece delivery point, characteristics and the USPS presort rules. Each mailpiece in the tray group 35 has been tracked through the inserter or wrapper, which enables the tray break for tray group 35. The control computer 50 sends the correct tray tag data to the printer 40 based on the parameters of tray group 35. Once the tray tag for group 35 is printed, the data is accumulation which is needed to print the tray tag for group 45, when requested. Since the address faces to the right of the operator 38, the tray tag must be placed on the right end of the mail tray. Mail trays often come equipped with a plastic sleeve to hold the tray tag. The position of the tray tag holder relevant to the mailpiece address location must be taken into account when empty trays are placed on the roller conveyor 29.

The roller conveyor 29 runs the entire length of the stacker conveyor 30 to support both full 32 and empty 34 mail trays. The roller conveyor is composed of a side rail 57 to support the rollers 52. A second side rail to support the other end of the roller can be used. The two side rail roller conveyors are commercially available. However, this configuration is not satisfactory for the on-edge stacker system 10 since the second side rail would prevent the positioning of trays against the side plate 55 and underneath the lip of the wear plate edge 59. If the mail tray is not under the edge 59 and against the side plate 55, the mailpiece tray group 35 would have to be lifted over the second side rail, thus defeating the design requirement that lifting motion of the mailpiece tray group 35 is replaced with a sliding motion by the operator 38. The tray group bundle is always supported on the bottom by either the wear plate 56 or the rounded wear plate edge during the sweeping operation. The solution is to integrate the bearing and support for the far end 53 of each roller 52 directly into the stacker conveyor 30 side plate 55. A movable stop 33 is located at the end of the roller conveyor to prevent mail trays from sliding off the conveyor onto the floor. A powered roller conveyor may be added at the end of the roller conveyor 29 to take away full trays to a staging area or automated tray sleeve mechanism thus eliminating the need for the operator to lift and place full mail trays 32 on a cart or pallet.

Figures 2, 2A:
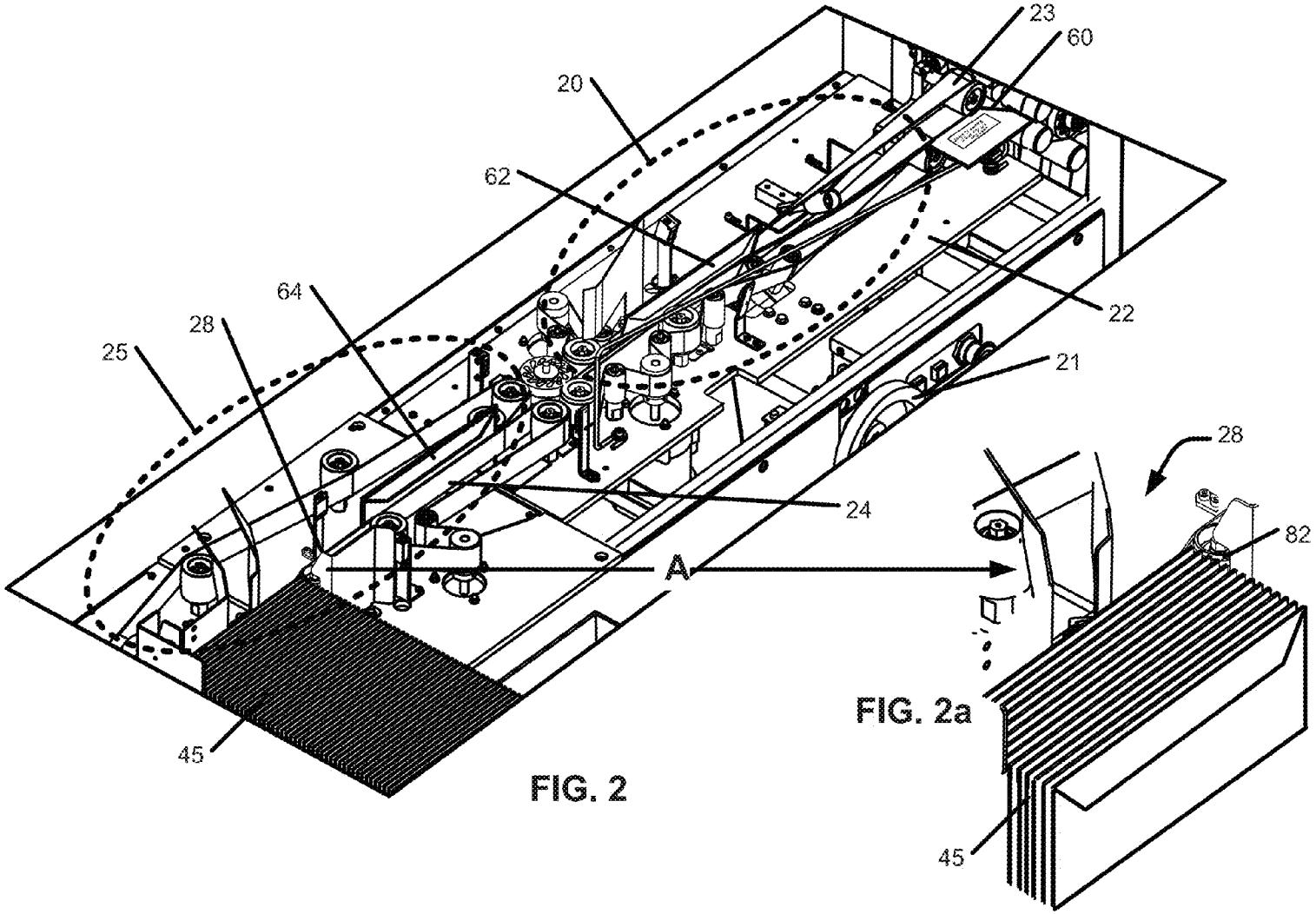
FIG. 2 is an exemplary expanded view illustration of the stacker and twister modules.
FIG. 2*a* is an exemplary expanded view illustration of the input roller assembly of the stacker module.

Alternate configurations of the on-edge stacker system 10 may be utilized to handle different system geometry requirements. For example, but not limited to, the stacker conveyor 30 can be designed for sweeping from the opposite side from where the operator 38 is shown or the stacker conveyor 30 may be configured on the right side of the stacker module 25 versus the left side as illustrated. The twister module 20 can stand mail on-edge, with either clockwise (CW) or counter clockwise (CCW) rotation from a flat position depending on the orientation of the envelope and the orientation of the stacker conveyor module 30—attached on the right or left side of the on edge stacker system 10. The direction of mailpiece rotation, CW or CCW, are design features that are implemented in the design layout and are not a parameter that can be changed job to job. Different envelope orientations can be accommodated such as, but not limited to, the address facing down when it enters the twist module 20 versus facing up as illustrated in FIG. 2 for envelope 60. The exemplary design features disclosed herein, which enable sweeping mailpiece tray groups without lifting, may be incorporated in these and additional alternative configurations which contribute to the flexibility of the design to handle multiple mail inserting or wrapping systems.

Turning now to FIG. 2 for a detailed illustration of the twist module 20 and the stacker module 25. Mailpieces 60 enter the twist module 20 from the in-feed transport module 15. The envelope 60 enters the twist module 20 address up and will be twisted counterclockwise to an on-edge orientation (envelope 62) ready for the stacker module 25 insertion of the envelope 64 into a mailpiece tray group 45 on the stacker conveyor 30. Since all mailpieces for a given production job are the same height and length, the utilization of a settling track to justify the bottom edge of the mailpiece just above the deck plate, after the twist, can be replace by a manual setup procedure. Rotating bottom edge adjustment handle 21 (shown in FIGS. 1 and 2) will move the twist module bottom plate 22 in or out. This adjustment effects how close to the bottom of the mailpiece 60 the twist module 20 transport belts 23 will grip the mailpiece 60 which in turn controls the height of the twisted mailpiece 62 above the deck plate 22.

Reference is now made to FIG. 2*a* for a detailed illustration of the tail roller assembly 28. Arrow A identifies the location of the tail roller assembly in the stacker module 25. The tail roller 82 serves as the return roller for the outer stacker transport belt 24. In addition, the tail roller 82 acts as a mailpiece tail removal device since the trailing edge of the most recent mailpieces inserted into the normal (not off-set) mailpiece tray group 45 remain in contact with the tail roller 82. Pulling the tails of mailpieces away from the mail path of the next mailpiece 64 reduces the possibility of a jam collision with the trailing edge of a mailpiece in the mailpiece tray group 45. The tail roller 82 is driven by the stacker transport belt 24.

FIGS. 3, 3*a*, 3*b* and 3*c* are additional illustrations of the stacker module 25 components. The arrows A, B and C provide a reference for the location within the stacker module 25 (FIG. 3) of the stacker conveyor control assembly 26, the mailpiece tray group offset assembly 27 and the tail roller assembly 28 respectively. Control features of the stacker conveyor control assembly 26, as illustrated in FIG. 3*a*, are the spring loaded pressure sensing fingers 75 that transmit the back pressure of the mailpieces on the stacker conveyor 30. The tray bundles are held in a vertical position between a fixed stacker back stop 78 and a moveable paddle 36 wherein the stack pressure is maintained by controlling the movement of the stacker conveyor bottom belts 54 by sensing the position of pressure sensing fingers 75 where the pressure is measured by the displacement of the fingers as sensed by a hall effect sensor. When back pressure exceeds a value determined by the deflection of the fingers against the spring force where the deflection in measured by a Hall Effect or proximity sensor 76, the conveyor drive belts 54 are driven away from the stacker module 25 until the pressure is relieved to a predetermined level suitable for mailpiece stacking of the next mailpiece 64. The features of the mailpiece tray group offset assembly 27 are illustrated in FIG. 3*b*. The normal position, for stacking mailpiece tray groups 45, is with the movable stop 72 actuated in the extended position (as shown). The movable stop 72 is extended under computer 50 (FIG. 1) control to create a normal stack 45 using a solenoid 73 or other electrical or pneumatic actuator. When an offset mailpiece tray group 48 is required, the movable stop 72 is withdrawn allowing the mailpieces to stack against the fixed stop 70. The mailpiece tray group offset assembly 27 is adjustable in position for different length mailpieces by loosing bolt 74 to allow the assembly to move in slot 77. Once adjusted, the bolt 74 is retightened. The proper adjustment position for the offset assembly 27 is set, with the movable stop 72 extended, such that the trailing edge of the mailpiece rests against the rounded wear plate edge 59. The normal position for a tray group bundle 45 to be stacked is the optimum position for ease of sweeping since the bundle is closest to the operator 38. Those skilled in the art may use other fasteners, such as but not limited to, bolts with a T handle attached or a combination of fasteners and guide pins. In addition, envelope lengths may be inscribed on the deck plate for quick reference during setup.

The adjustment capability in the mailpiece tray group offset assembly 27 is critical to the correct stacking of the normal mailpiece tray group 45. Prior art stackers are designed to justify the leading edge of the mailpiece against the far wall of the stacker conveyor 30 to avoid setup steps. However, this approach fails to provide an ergonomically favorable design for the operator. Testing has shown that the best position for the normal mailpiece tray group 45 is to justify the mailpiece trailing edge on the wear plate edge 59 by moving the tray group offset assembly 27. Any time saved with the prior art design, which does not require setup for different mailpiece lengths, is in significant compared to the time saved during the sweeping process when the ergonomically friendly design disclosed herein is implemented.

FIG. 3*c* is an alternative view of the tail roller assembly 28. The protective roller shield 80 is a metal shield to prevent the trailing edge of the mailpiece from being damaged by the belt that drives the tail roller 82. The final mailpiece tracking photocell 84 before the mailpiece is stacked is shown. The photocell is used to confirm that the mailpiece arrived at the expected time based on mailpiece tracking by the control computer 50. If the next expected mailpiece arrives late or not at all then a jam condition or mailpiece fly out has occurred.

Figure 4:
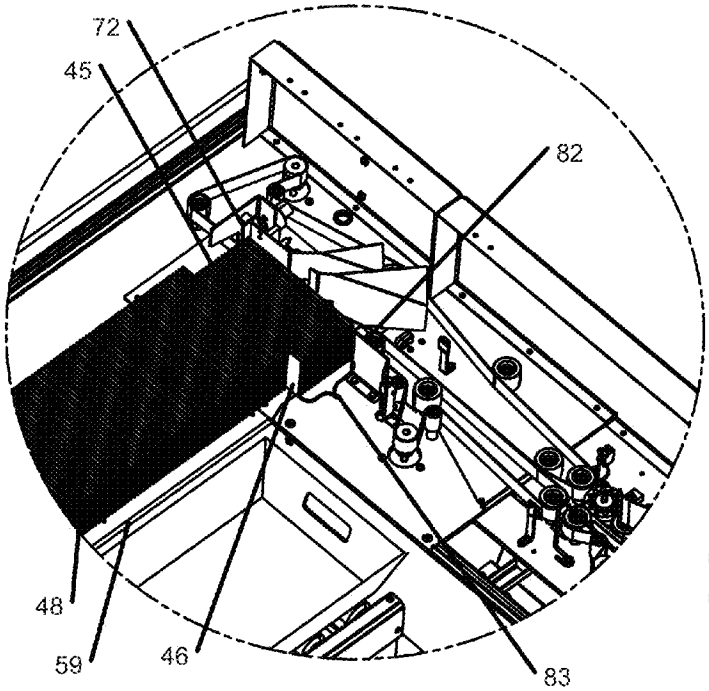
FIG. 4 is an exemplary illustration of a normal (not offset) position mail group being stacked on-edge.

Attention is now directed to FIG. 4 to illustrate the change over from an offset mailpiece tray group 48 to a normal mailpiece tray group 45 by the extension of the movable stop 72. The resulting tray break 46 is clearly visible making it easy for the operator 38 to grasp the offset mailpiece tray group 48 for sweeping. The tail roller 82 is in contact with the mailpieces in the stack only long enough to get the trailing edge out of the way of the leading edge of the next mailpiece to enter the stacker 25 and to push the trailing edge onto the shield 80. The trailing edges 83 of the mailpieces in the normal mailpiece tray group 45 are aligned so that the trailing edges 83 will line up with the wear plate edge 59.

Figure 5:
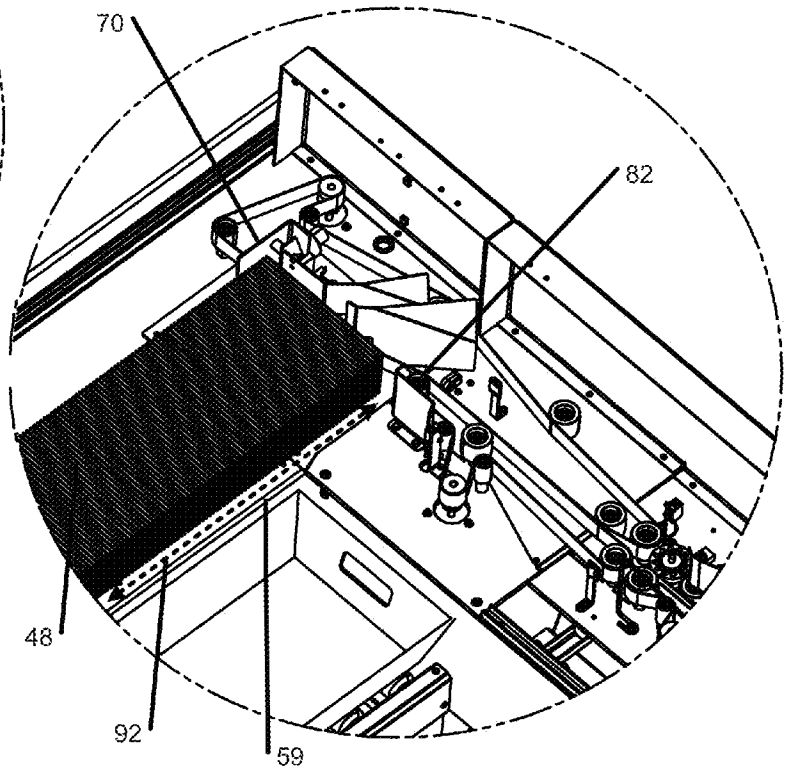
FIG. 5 is an exemplary illustration of an offset mail bundle being stacked on-edge.

FIG. 5 illustrates an offset mailpiece tray group 48 that is created by stacking the mailpieces against the fixed stop 70. The offset mailpiece tray group 48 is offset approximately 1 inch from the wear plate edge 59. Testing has shown that the 1 inch offset from the wear plate edge 59 is the best trade-off for the mailpiece trailing edge. The 1 inch offset has only minimal impact on the sweeping operation. The arrow 92 illustrates that the offset extends over the full length of the offset mailpiece tray group 48. Further testing may indicate a different offset amount. The tail roller 82 is not in contact with the offset mailpiece tray group 48.

Figure 6:
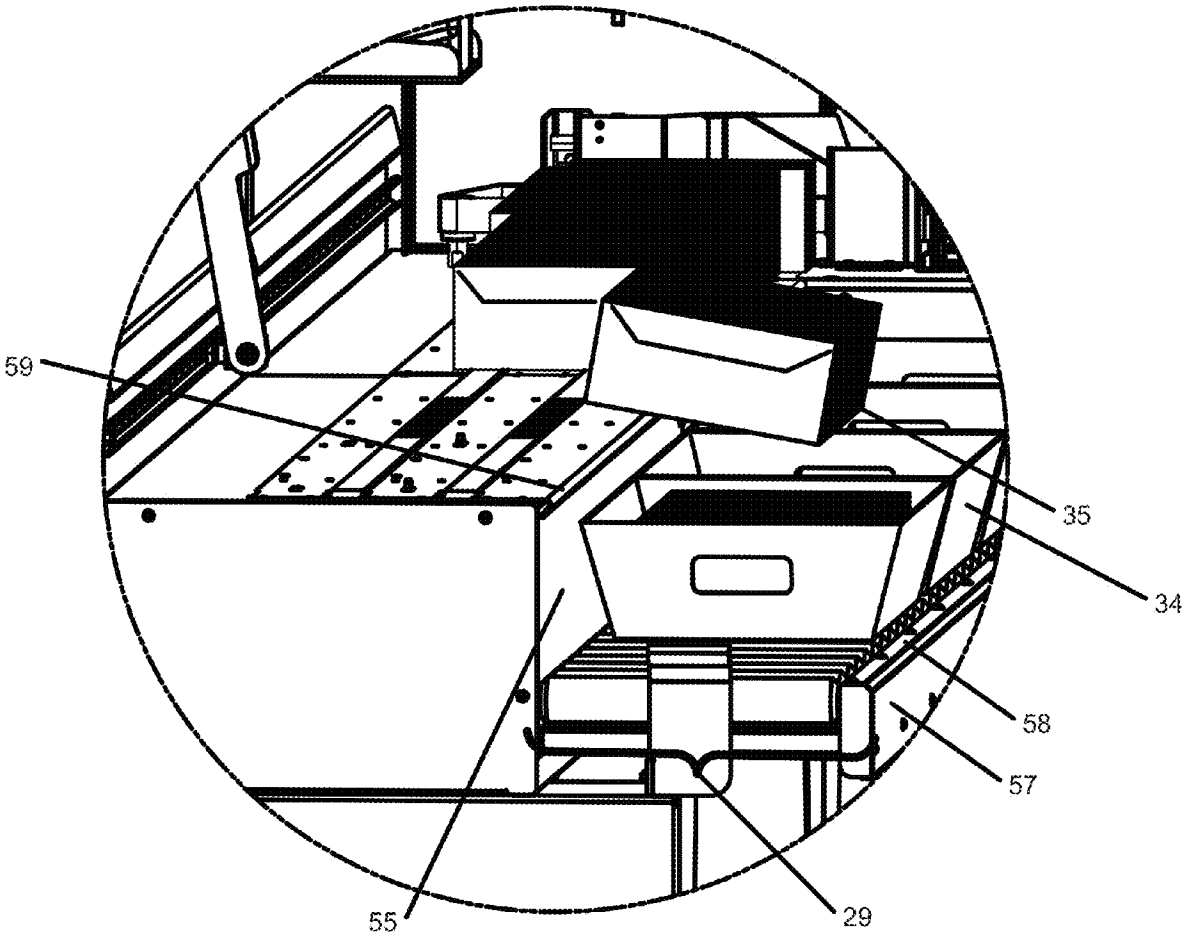
FIG. 6 is an exemplary illustration of a mail bundle being slid over the edge of the stacker conveyor.

FIG. 6 is an end view of the stacker conveyor 30 and the roller conveyor 29. The mailpiece tray group 35, which is being swept, is supported by the wear plate edge 59. The empty mail tray 34 is tight against the stacker side plate 55, which minimizes the center bowing of the mail tray. The center bowing of the mail trays needs to be minimized since it increases the risk that the operator 38 will not be able to slide the mailpiece tray group 35 directly into the mail tray 34. Although not shown, an extension 58 is added above the roller conveyor side rail 57 to assist keeping the bowed mail tray 34 tight against the stacker conveyor side plate 55 and to keep mail trays from sliding off the roller conveyor 29 toward the operator 38.

Testing has revealed that several required design features associated with the wear plate edge 59 were clear improvements over existing system designs. FIG. 7 illustrates these design features. The wear plate 56*a* could not have a simple edge cut off flush with the stacker conveyor side plate 55, because mailpiece tray group 35 incurred damage and too much friction when it was slid over the edge. The wear plate edge 59 needed to extend over the mail tray 34 to better facilitate a smooth slide and placement of the mailpiece tray group 35 into the bowed mail tray 34. The solution to these issues was to put a rolled edge 59 with a ½ inch diameter on the stainless steel wear plate 56*a*. This design also provided a ½ inch extension out over the mail tray 34. The extension is small but produced a significant improvement in the sweep and mail tray loading process. Adjustments to the diameter of the rolled wear plate edge 59 may be made as a result of further testing with a larger variety of mailpiece characteristics.

FIG. 8 illustrates an alternate solution to the rolled edge 59. A roller assembly 106 may be attached to the end of the wear plate 56*b*. The roller assembly 106 may be segmented since it must extend the full length of the stacker conveyor 30. The roller also is ½ inch diameter and extends beyond the stacker conveyor side plate 55 and over the mail tray 34. The roller 106 material may be metal such as stainless steel or a plastic such as a ultra-high-molecular-weight polyethylene (UHMW). The friction between the mailpiece bottom edge and the roller 106 material must be determined through additional testing. The roller 106 will not be able to turn freely on its mounting shaft since that could result in loss of control of the tray bundle 35 during sweeping.

As shown by the above discussion, functions relating pertain to the operation of an inserting system wherein on-edge stacker system 10 control is implemented in the hardware and controlled by one or more computers operating as the inserter control computer 50 which are connected to the inserting system and possibly to a data center processor/server for data communication with other factory the processing resources as shown in FIG. 1. Although special purpose devices may be used, such devices also may be implemented using one or more hardware platforms intended to represent a general class of data processing device commonly used to run "server" programming so as to implement the functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data. The software code is executable by the general-purpose computer that functions as the control processor 170 and/or the associated terminal device. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for tracking of mail items through a postal authority network with reference to a specific mail target, in essentially the manner performed in the implementations discussed and illustrated herein.

Figure 9:
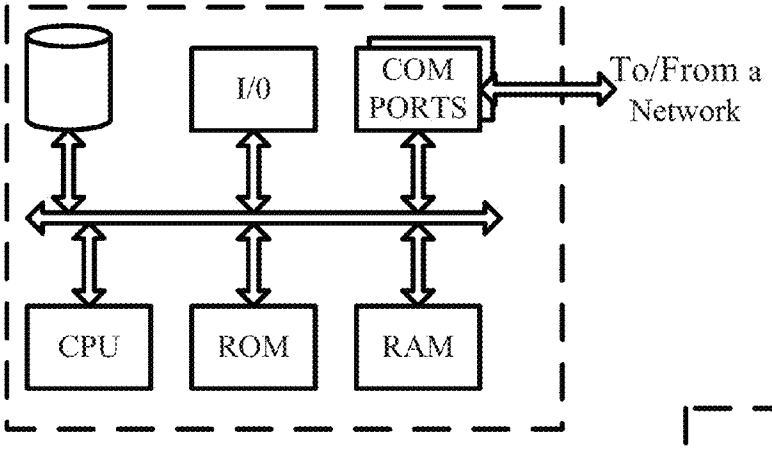
FIG. 9 illustrates a network or host computer platform, as may typically be used to implement a server.
Figure 10:
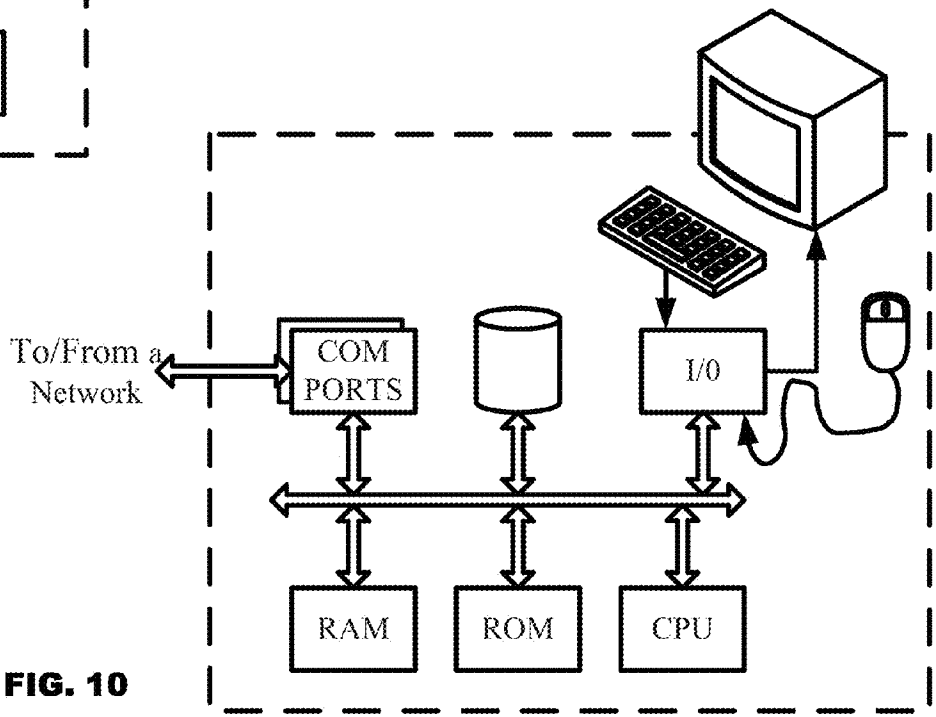
FIG. 10 depicts a computer with user interface elements, as may be used to implement a personal computer or other type of work station or terminal device.

FIGS. 9 and 10 provide functional block diagram illustrations of general purpose computer hardware platforms. FIG. 9 illustrates a network or host computer platform, as may typically be used to implement a server. FIG. 9 depicts a computer with user interface elements, as may be used to implement a personal computer or other type of work station or terminal device, although the computer of FIG. 9 may also act as a server if appropriately programmed. It is believed that those skilled in the art are familiar with the structure, programming and general operation of such computer equipment and, as a result, the drawings should be self-explanatory.

For example, inserter control computer 50 may be a PC based implementation of a central control processing system like that of FIG. 9, or may be implemented on a platform configured as a central or host computer or server like that of FIG. 10. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer in a document factory may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for tracking of mail items through a postal authority network with reference to a specific mail target, as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model—i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as a "program article of manufacture" may take the form of code or executable instructions for causing a computer or other programmable equipment to perform the relevant data processing steps, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer (s) or the like. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

In the detailed description above, numerous specific details are set forth by way of examples in order to provide a thorough understanding of the relevant teachings. However, it should be apparent to those skilled in the art that the present teachings may be practiced without such details. In other instances, well known methods, procedures, components, and software have been described at a relatively high-level, without detail, in order to avoid unnecessarily obscuring aspects of the present teachings.

REFERENCE SIGNS

10 non-edge stacker system
11 arrow
15 in-feed transport module
16 roller nip
20 twist module
21 bottom edge adjustment handle
22 twist module bottom plate
23 transport belt
24 stacker transport belt
25 stacker module
26 stacker conveyor control assembly
27 mailpiece tray group offset assembly
28 tail roller assembly
29 roller conveyor
30 stacker conveyor module
32 full tray
33 movable stop
34 empty tray
35 mailpiece tray group
36 stacker paddle
38 operator
40 tray tag printer
45 completed mail tray group
46 tray brake
48 mailpiece tray group
50 control computer
52 roller
53 far end
54 drive belts
55 side plate
56 wear plate
57 side rail
58 extension
59 wear plate edge
60 envelope
62 envelope
64 envelope
70 fixed stop
72 movable stop
73 solenoid
74 bolt
75 pressure sensing finger
76 proximity sensor
77 slot
78 fixed stacker back stop
80 protective roller shield
82 tail roller
83 trailing edges
84 photocell
90 direction
91 direction
92 direction
100 inserter system
105 base track
106 roller assembly
110 insert feeder station
111 insert feeder station
112 insert feeder station
120 finger
121 finger
122 finger
123 finger
124 finger
130 input channel
131 document page
132 document sheet feeder
133 control code reader
134 accumulator
135 folder
136 collector
140 envelope stuffing station
200 wrapper
201 document and insert subsystem
202 wrapping mailpiece preparation subsystem
203 wrapper
205 paper roll
210 cutter
215 accumulator folder
220 document
221 document
223 document+insert
225 collation track
235 insert feeder
236 insert feeder
240 wrapper roll
250 perforation and glue system
260 cut
265 wrapper paper
300 letter/finished mailpiece
302 adress block window
305 control code
310 sequence number
315 barcode

What is claimed is:

1. A stacker system for stacking mailpieces received from an output section of mail processing equipment, the stacker system comprising:

an in-feed transport section for receiving the mailpieces from the output section of the mail processing equipment;

a stacker module configured to receive the plurality of mailpieces, by their leading edges, in an on-edge orientation and stack the mailpieces to form a mailpiece tray bundle;

a conveyor module including at least one conveyor drive belt and a wear plate having a rounded edge, the wear plate configured to receive the mailpiece tray bundle driven by the conveyor drive belt, wherein trailing edges of the mailpieces of the mailpiece tray bundle are justified at the rounded edge of the wear plate;

a side plate extending from the bottom of the stacker conveyor module;

a roller conveyor positioned adjacent to the side plate and parallel with the stacker conveyor module such that the side plate is between the stacker conveyor module and the roller conveyor module; and the roller module being positioned below the edge of the wear plate, the roller conveyor configured to receive the mailpiece tray bundle over the rounded edge of the wear plate and into a mail tray positioned on the roller conveyor, wherein the rounded edge of the wear plate overhangs the roller conveyor and the side plate such that the mail tray bundle can be slidably moved across an upper surface of the rounded edge without damaging the mailpieces.

2. The stacker system of claim 1, further comprising a control processor programmed to:

control a movable back stop of the stacker module based on bundle break points and presort bundle groups to form the mailpiece tray bundle; and control printing of a tray tag for the mailpiece tray bundle received in the mail tray.

3. The stacker system of claim 1, wherein the roller conveyor comprises a plurality of rollers mounted between a side rail of the roller conveyor and a side plate of the stacker module.

4. The stacker system of claim 1, wherein the in-feed transport module is configured to elevate the height of the mailpieces received from the output section of the mail processing equipment.

5. The stacker system of claim 1, further comprising:

a twist module positioned between the in-feed transport module and the stacker module, the twist module configured to receive each mailpiece in an address up configuration and twist the mailpiece counterclockwise to the on-edge orientation for processing by the stacker module.

6. The stacker system of claim 1, wherein the rounded edge of the conveyor module is comprised of a metal and having a ½ inch diameter bend or a ½ inch roller assembly.

7. The stacker system of claim 2, wherein the mailpiece tray bundle is positioned between the fixed back stop and a moveable paddle, wherein stack pressure is maintained the control processor controlling movement of the conveyor belts by sensing a position of pressure sensing fingers, wherein the pressure is measured by displacement of the pressure sensing fingers by way of a hall effect sensor.

8. The stacker system of claim 1, wherein the mail processing equipment is selected from an inserter or wrapper.

9. The stacker system of claim 2, wherein the processor is configured to:

track each mailpiece during its processing in the mail processing equipment; and control a movable back stop of the stacker module based on bundle break points and presort bundle groups to form the mailpiece tray bundle.

10. The stacker system of claim 1, wherein the roller conveyor further comprises a movable stop plate located at an end of the roller conveyor to prevent mail trays from sliding off the roller conveyor.

11. The stacker system of claim 1, wherein the stacker module further comprises a fixed backstop for stopping the leading edge of each mailpiece received.

12. A method for stacking mailpieces, the method comprising steps of:

inputting, at an in-feed transport section of a stacker system, the mailpieces from an output section of mail processing equipment;

receiving the plurality of mailpieces in an on-edge orientation in a stacker module;

stacking the mailpieces in the stacker module to form a mailpiece tray bundle;

justifying trailing edges of the mailpieces of the mailpiece tray bundle at a rounded edge of a wear plate of a conveyor module; and conveying the mailpiece tray bundle along conveyor belts of the conveyor module; and sweeping the mailpiece tray bundle over an upper surface of the rounded edge of the stacker conveyor module in a direction that perpendicular to the direction of travel of the conveyor belts and into a mail tray positioned on a roller conveyor positioned parallel to the stacker conveyor module and below the rounded edge of the wear plate, wherein the rounded edge of the wear plate overhangs the roller conveyor and the mailpiece tray bundle is slidably moved across the upper surface of the rounded edge without damaging the mailpiece tray bundle and without having to lift up the mailpiece tray bundle.

13. The method of claim 12, further comprising the steps of:

controlling, by way of a programmed processor, a movable back stop of the stacker module based on bundle break points and presort bundle groups to form the mailpiece tray bundle; and control, by way of the programmed processor, printing of a tray tag for the mailpiece tray bundle received in the mail tray.

14. The method of claim 12, further comprising the step of:

elevating the height of the mailpieces received from the output section of the mail processing equipment by the in-feed transport module.

15. The method of claim 12, further comprising the steps of:

receiving each mailpiece in an address up orientation at a twist module; and twisting each mailpiece counterclockwise to the on-edge orientation for processing by the stacker module.

16. The method of claim 13, further comprising the steps of:

positioning the mailpiece tray bundle between the fixed back stop and a moveable paddle;

maintaining stack pressure by the programmed processor controlling movement of the conveyor belts by sensing a position of pressure sensing fingers, wherein the pressure is measured by displacement of the pressure sensing fingers by way of a hall effect sensor.

17. The method of claim 13, further comprising the steps of:

tracking each mailpiece during its processing in the mail processing equipment; and controlling a movable back stop of the stacker module based on bundle break points and presort bundle groups to form the mailpiece tray bundle.

18. The method of claim 12, wherein the sweeping step is performed by way of an operator without lifting up the mailpiece tray bundle.

19. The method of claim 18, wherein the mailpiece tray bundle is pulled over the rounded edge of the conveyor module and into the mail tray, wherein the rounded edge comprises a ½ inch diameter bend or a ½ inch roller assembly.

20. The method of claim 12, wherein the stacker module includes a fixed backstop for stopping a leading edge of each mailpiece received.

* * * * *

UNITED STATES PATENT AND TRADEMARK OFFICE

CERTIFICATE OF CORRECTION

PATENT NO. : 9,221,640 B2
APPLICATION NO. : 13/844290
DATED : December 29, 2015
INVENTOR(S) : Middelberg et al.

It is certified that error appears in the above-identified patent and that said Letters Patent is hereby corrected as shown below:

On title page, item 72 Inventors
replace "Neal Middleberg"
with --Neal Middelberg--.

On title page, item 72 Inventors
replace "Gerard A. Derome"
with --Gerard A. DeRome--.

Signed and Sealed this
Thirty-first Day of May, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,221,640 B2
APPLICATION NO. : 13/844290
DATED : December 29, 2015
INVENTOR(S) : Middleberg et al.

It is certified that error appears in the above-identified patent and that said Letters Patent is hereby corrected as shown below:

In the claims,

Col. 16, line 18, please correct claim 12 as follows:

After the word "that"
Insert --is--.

Signed and Sealed this
Fifth Day of July, 2016

Michelle K. Lee

Michelle K. Lee
*Director of the United States Patent and Trademark Office*